US009805660B2

(12) United States Patent
Hayashi et al.

(10) Patent No.: US 9,805,660 B2
(45) Date of Patent: Oct. 31, 2017

(54) DISPLAY DEVICE AND METHOD FOR CORRECTING SIGNAL VOLTAGE USING DETERMINED THRESHOLD VOLTAGE SHIFT

(71) Applicant: JOLED INC., Tokyo (JP)

(72) Inventors: Hiroshi Hayashi, Hyogo (JP); Takahiro Kawashima, Osaka (JP)

(73) Assignee: JOLED INC., Tokyo (JP)

( * ) Notice: Subject to any disclaimer, the term of this patent is extended or adjusted under 35 U.S.C. 154(b) by 77 days.

(21) Appl. No.: 14/554,997

(22) Filed: Nov. 26, 2014

(65) Prior Publication Data

US 2015/0161968 A1 Jun. 11, 2015

(30) Foreign Application Priority Data

Dec. 11, 2013 (JP) ..... 2013-256249

(51) Int. Cl.
*G09G 3/30* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0842* (2013.01)

(58) Field of Classification Search
CPC ..... G09G 3/3291; G09G 3/3233
See application file for complete search history.

(56) References Cited

U.S. PATENT DOCUMENTS

2006/0187154 A1* 8/2006 Tsuchida ..... G09G 3/3233 345/76
2008/0094320 A1* 4/2008 Parikh ..... G09G 3/3233 345/76
2010/0073265 A1 3/2010 Hirai et al.
2012/0299978 A1* 11/2012 Chaji ..... G09G 3/3291 345/690
2015/0145845 A1* 5/2015 Nam ..... G09G 3/3233 345/209

FOREIGN PATENT DOCUMENTS

JP 2009-104104 5/2009
JP 2009-276673 11/2009
JP 2011-221202 11/2011

OTHER PUBLICATIONS

Japan Office Action, dated Jul. 4, 2017, in the corresponding Japanese Patent Application No. 2013-256249.

* cited by examiner

*Primary Examiner* — Kwang-Su Yang
(74) *Attorney, Agent, or Firm* — Greenblum & Bernstein, P.L.C.

(57) ABSTRACT

A display is provided that includes a display having a light-emitting element and a drive transistor, which supplies a current to the light-emitting element causing the light-emitting element to emit light. The display also includes a signal line driving circuit that supplies a signal voltage applied between a gate and a source of the drive transistor, and a control circuit that calculates an amount of threshold voltage shift of the drive transistor on the basis of an amount of deterioration of a threshold voltage of the drive transistor during a deterioration period, and corrects the signal voltage in accordance with the amount of threshold voltage shift.

7 Claims, 11 Drawing Sheets

DISPLAY DEVICE AND METHOD FOR CORRECTING SIGNAL VOLTAGE USING DETERMINED THRESHOLD VOLTAGE SHIFT

This application claims priority to Japanese Patent Application No. 2013-256249, filed on Dec. 11, 2013, the contents of which are hereby incorporated by reference.

BACKGROUND

1. Technical Field

The present disclosure relates to a display device that includes a drive transistor for causing a light-emitting element to emit light.

2. Description of the Related Art

In recent years, organic EL (Electro Luminescence) displays utilizing organic EL have attracted attention as one of the next-generation flat panel display taking the place of liquid crystal displays. Active matrix type display devices such as organic EL displays use a thin film transistor (TFT) as a drive transistor.

SUMMARY

In a TFT, a threshold voltage of the TFT shifts due to a voltage stress such as a voltage applied between a gate and a source upon energization. The amount of shift changes in a positive or negative direction depending on the gate-source voltage. The shift of the threshold voltage over time becomes a cause for a fluctuation in the amount of electric current supplied to organic EL and therefore affects luminance control of a display device. This undesirably results in deteriorated display quality.

In view of this problem, an aspect of the present disclosure provides a display device and a method for driving a display device that make it possible to reduce the influence of a shift over time of a drive transistor threshold voltage on luminance control and thereby suppress deterioration of display quality.

Additional benefits and advantages of the disclosed embodiments will be apparent from the specification and figures. The benefits and/or advantages may be individually provided by the various embodiments and features of the specification and drawings disclosure, and need not all be provided in order to obtain one or more of the same.

A display device according to the present disclosure includes a display section including light-emitting pixels each of which including a light-emitting element and a drive transistor, the drive transistor including a gate electrode, a source electrode and a drain electrode, and being configured to supply a current to the light-emitting element to cause the light-emitting element to emit light; a signal line driving circuit configured to: supply a signal voltage applied between the gate electrode and the source electrode of the drive transistor; and a control circuit configured to calculate an amount of threshold voltage shift of the drive transistor on the basis of the amount of deterioration of a threshold voltage of the drive transistor during a deterioration period in which the signal voltage is kept at a value that is not zero and an amount of recovery of the threshold voltage of the drive transistor during a recovery period in which the signal voltage is kept at zero; and correct the signal voltage in accordance with the amount of threshold voltage shift.

These general and specific aspects may be implemented using a driving method, an electronic device, a system, and an integrated circuit, and any combination of a driving method, an electronic device, a system, and an integrated circuit.

According to the present disclosure, it is possible to provide a display device and a method for driving the display device that make it possible to suppress a difference between the amount of threshold voltage shift that is calculated to correct a voltage applied to a drive transistor and the actual amount of threshold voltage shift.

DETAILED DESCRIPTION

First, the following describes matters which the inventors of the present invention studied to accomplish the aspects of the present disclosure.

One method for suppressing the influence of a threshold voltage shift on a luminance change of organic EL is to supply a desired amount of electric current to organic EL by offsetting a video signal voltage applied between a gate and a source by the amount of shift of the threshold voltage (for example, Japanese Unexamined Patent Application Publication No. 2009-104104 A). One example of a method for estimating the amount of shift of a threshold voltage is a method for estimating the amount of shift of a threshold voltage on the basis of the accumulated amount of gate-source voltage ($V_{gs}$) stress that is calculated from a history of a video signal voltage. However, an actual display is not always in a state of operation, and there is a non-operation period. A threshold voltage shift of a TFT during the non-operation period sometimes partly recovers depending on $V_{gs}$. Accordingly, there arises a difference between the amount of threshold voltage shift that is estimated from the accumulated amount of stress and the actual amount of threshold voltage shift, and this difference accumulates with passage of time. Accordingly, the estimated amount of threshold voltage shift is more different from the actual amount of threshold voltage shift of the TFT with passage of time. This results in a problem that in a case where an offset amount of video signal voltage determined on the basis of the estimated amount of threshold voltage shift is used, a desired amount of electric current cannot be supplied to organic EL.

In view of this, one aspect of the present disclosure provides a display device and a method for driving a display device that make it possible to suppress a difference between the amount of threshold voltage shift that is calculated to correct a voltage applied to a drive transistor and the actual amount of threshold voltage shift.

Findings on which Present Disclosure is Based

Findings on which the present disclosure is based are described below before describing the details of the present disclosure.

Figure 1:
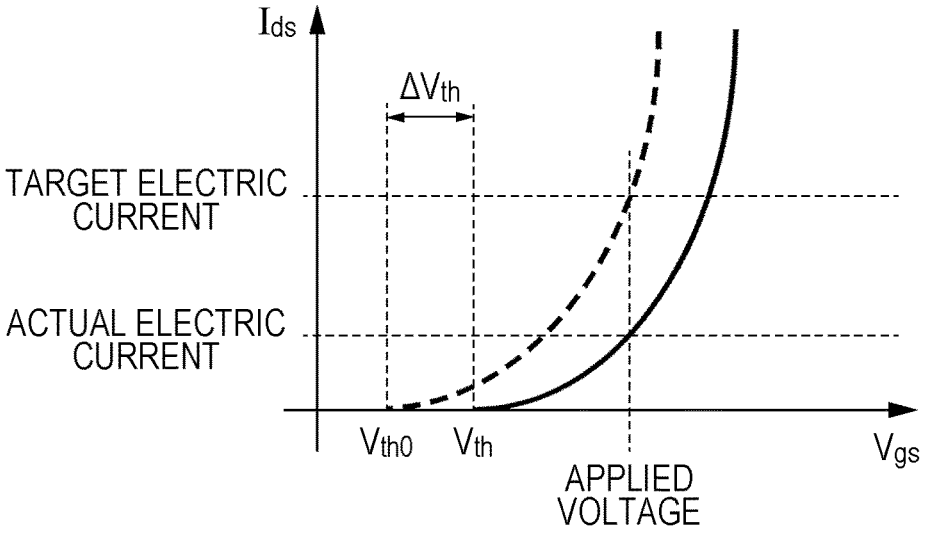
FIG. 1 is a view illustrating an outline of transmission characteristics of a TFT.

A threshold voltage of a drive transistor included in a light-emitting pixel of an organic El display device is described. A threshold voltage of a drive transistor that is a TFT changes over time upon application of a voltage. That is, when a bias is applied to a gate electrode of the drive transistor, electrons are injected to a gate insulating film upon application of a positive bias, and holes are injected to the gate insulating film upon application of a negative bias. Accordingly, a positive or negative threshold voltage shift occurs. FIG. 1 is a graph showing an outline of a relationship (transmission characteristics) between a gate-source voltage $V_{gs}$ (video signal voltage) applied between a gate and a source of the drive transistor and an electric current $I_{ds}$ (electric current supplied to organic EL) flowing between a drain and the source. In FIG. 1, the broken line indicates transmission characteristics of the drive transistor obtained at start of use. The solid line indicates transmission characteristics obtained after the threshold voltage is changed by application of a voltage. As illustrated in FIG. 1, the threshold voltage of the TFT shifts from $V_{th0}$ to $V_{th}$ upon application of a voltage between the gate and the source. Accordingly, even if an applied voltage needed for obtaining a target electric current at the start of use is applied after the threshold voltage shift, the target electric current cannot be obtained. Consequently, a desired amount of electric current cannot be supplied to organic EL.

Figure 2:
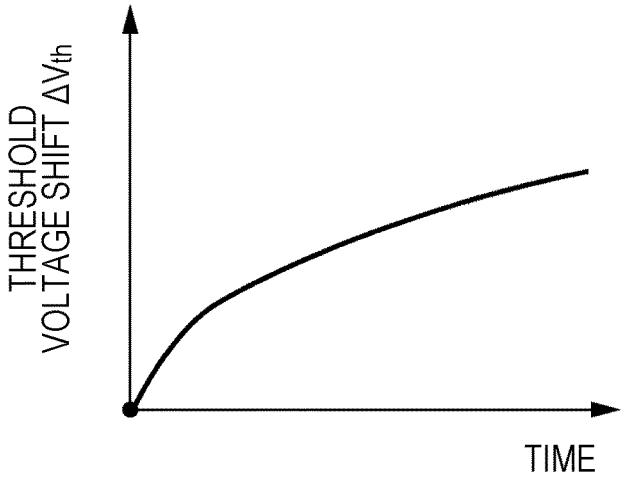
FIG. 2 is a graph illustrating a modeled relationship between a stress application time of the TFT and a threshold voltage shift ΔVth.

In view of this, in an organic EL display device according to the findings on which the present disclosure is based, a gate-source voltage $V_{gs}$ is offset by the amount of threshold voltage shift $\Delta V_{th}$ in order to suppress the influence of a threshold voltage shift on a luminance change of organic EL. The offset amount of gate-source voltage $V_{gs}$ is determined on the basis of an accumulated amount of stress on a drive transistor that is calculated from a history of the gate-source voltage $V_{gs}$. For example, a relationship between an application time and the amount of threshold voltage shift $\Delta V_{th}$ in a case where a predetermined stress (gate-source voltage) is applied to the drive transistor can be determined by, for example, experiments etc. Based on the relationship thus obtained, a model for predicting the amount of threshold voltage shift $\Delta V_{th}$ with respect to the accumulated amount of stress is created. FIG. 2 is a graph illustrating a modeled relationship between the stress application time and the amount of threshold voltage shift $\Delta V_{th}$. By using the model as illustrated in FIG. 2, the offset amount of gate-source voltage $V_{gs}$ is determined so as to compensate the amount of threshold voltage shift $\Delta V_{th}$ corresponding to the accumulated amount of stress.

However, in an actual TFT, a threshold voltage shift partly recovers in a case where a voltage is not applied. That is, in a state in which a bias on a gate of the TFT is 0 V, electrons or holes injected into a gate insulating film escape from the gate insulating film due to thermal energy of the environmental temperature, and the threshold voltage shift recovers. Accordingly, there arises a difference between the offset amount determined on the basis of the accumulated amount of stress and the amount of threshold voltage shift $\Delta V_{th}$, and this difference accumulates with passage of time.

Next, a result of the experiment that confirmed the recovery of the threshold voltage shift is described. In this experiment, a stress application step of applying, as a stress, a gate-source voltage of 20 V to a TFT for 30 minutes and a stress relief step of relieving the TFT in a state where the gate-source voltage of the TFT is 0 V for three hours were repeated. In the stress application step, a gate electric potential $V_g$ was set to 20 V and a source electric potential $V_s$ and a drain electric potential $V_d$ were set to 0 V. In the stress relief step, the gate electric potential $V_{gs}$ the source electric potential $V_s$ and the drain electric potential $V_d$ were set to 0 V. In the experiment, a TFT that includes a gate insulating film consisting of a silicon nitride film having a thickness of 220 nm and a silicon oxide film having a thickness of 50 nm, and a semiconductor layer consisting of an oxide semiconductor having a thickness of 90 nm was used. In the experiment, the environmental temperature was kept at 45° C.

The results of the experiment are described with reference to FIGS. 3 to 8.

Figure 3:
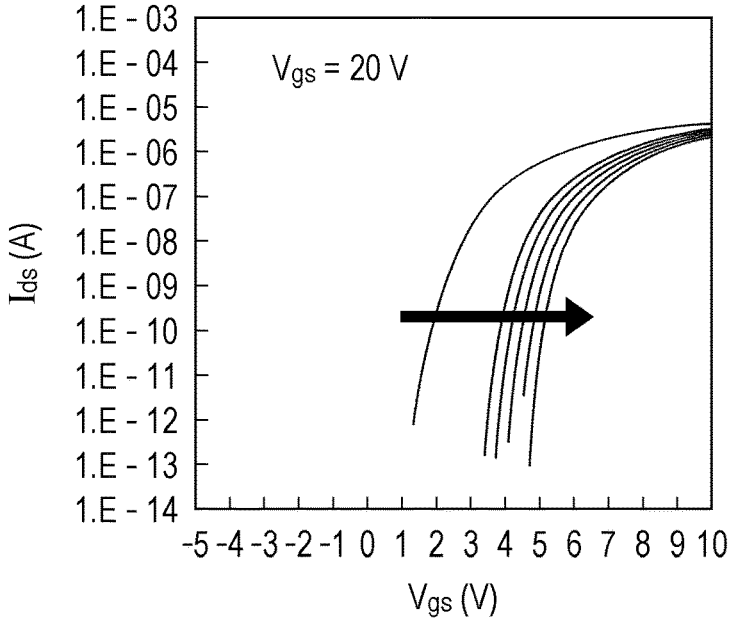
FIG. 3 is a graph illustrating how the transmission characteristics of the TFT change with passage of time during application of the stress.

FIG. 3 is a view illustrating a change of transmission characteristics of the TFT over time in the first stress application step. The black arrow in FIG. 3 indicates passage of time (the same applies to FIGS. 4 to 7). It can be confirmed from FIG. 3 that the curve representing the transmission characteristics shifts rightward over time, that is, the threshold voltage of the TFT shifts in a positive direction.

Figure 4:
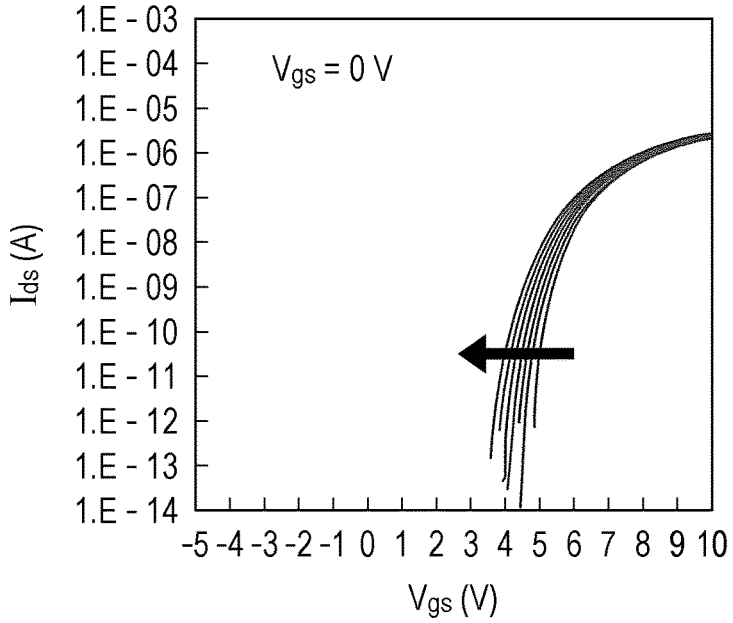
FIG. 4 is a graph illustrating how the transmission characteristics of the TFT change with passage of time during a period in which the TFT is relieved of a stress.

FIG. 4 is a view illustrating a change of transmission characteristics of the TFT over time in the first stress relief step that follows the first stress application step. It can be confirmed from FIG. 4 that the curve representing the transmission characteristics shifts leftward over time, that is, the threshold voltage of the TFT shifts in a negative direction.

Figure 5:
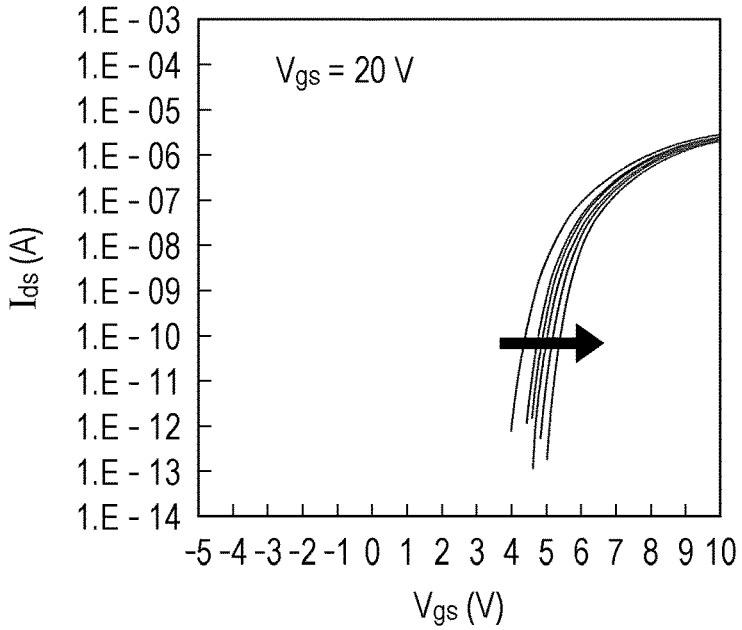
FIG. 5 is a graph illustrating how the transmission characteristics of the TFT change with passage of time during application of the stress.
Figure 6:
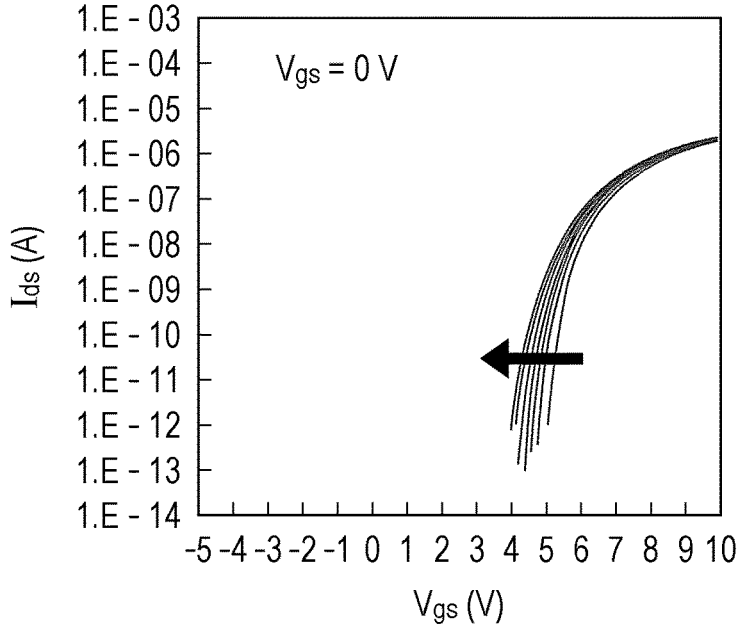
FIG. 6 is a graph illustrating how the transmission characteristics of the TFT change with passage of time during a period in which the TFT is relieved of a stress.
Figure 7:
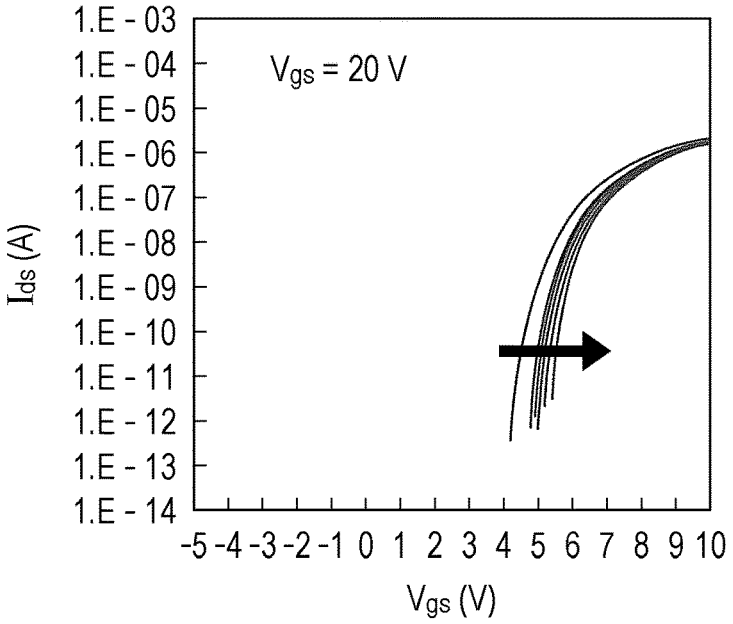
FIG. 7 is a graph illustrating how the transmission characteristics of the TFT change with passage of time during application of the stress.

FIGS. 5, 6, and 7 are views illustrating changes of the transmission characteristics of the TFT over time in the second stress application step, the second stress relief step, and the third stress application step, respectively. As in FIGS. 3 and 4, it can be confirmed from FIGS. 5, 6, and 7 that the threshold voltage of the TFT shifts in a positive direction in the stress application steps. It can be also confirmed that, in the stress relief step, the threshold voltage shifts in a negative direction, that is, the threshold voltage recovers.

Figure 8:
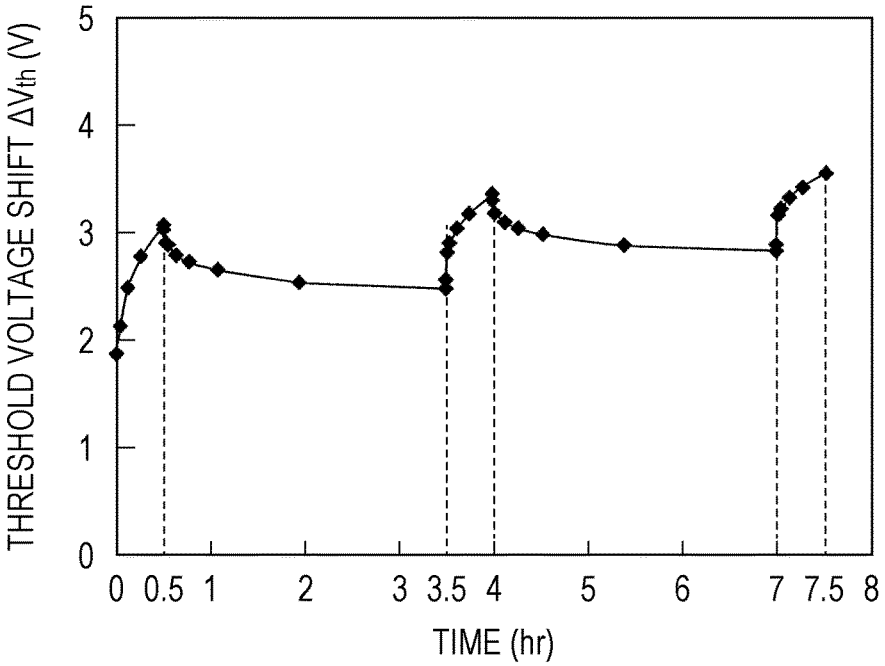
FIG. 8 is a graph illustrating how the threshold voltage shift of the TFT changes with passage of time in a case where a stress application step and a stress relief step are repeated.

FIG. 8 is a graph illustrating a change of the threshold voltage shift over time. As illustrated in FIG. 8, it can be confirmed that the threshold voltage shifts in a positive direction in the stress application step, and the threshold voltage recovers and shifts in a negative direction in the stress relief step.

Figure 9:
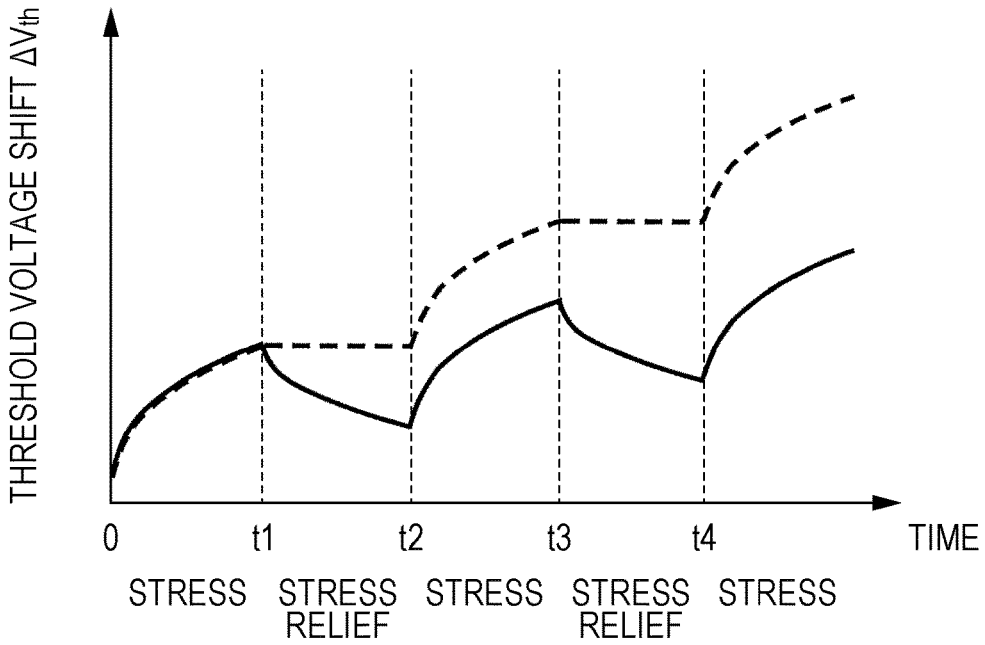
FIG. 9 is a graph illustrating an outline of how the threshold voltage shift of the TFT changes with passage of time in a case where a stress application step and a stress relief step are repeated.

Here, the threshold voltage shift obtained by using the model as illustrated in FIG. 2 and the threshold voltage shift in the actual TFT are compared. FIG. 9 is a graph illustrating an outline of the threshold voltage shift in a case where the stress application step and the stress relief step are repeated in the TFT. FIG. 9 illustrates the threshold voltage shift obtained on the basis of the model (the dotted line) and the threshold voltage shift in the actual TFT (the solid line). As illustrated in FIG. 9, in the actual TFT, the threshold voltage shift partly recovers during periods in which the TFT is relieved of a stress. Meanwhile, the model does not consider the influence of the recovery. Accordingly, there arises a difference between the amount of threshold voltage shift estimated from accumulated stress and the actual amount of threshold voltage shift, and this difference accumulates with passage of time. Accordingly, the estimated amount of threshold voltage shift is more different from the actual amount of threshold voltage shift with passage of time. This causes a problem that in a case where an offset amount of video signal voltage determined by estimating the amount of threshold voltage shift is used, a desired amount of electric current cannot be supplied to organic EL.

A display device and a method for driving a display device according to the present disclosure that can prevent such a problem is described below.

Outline of Present Disclosure

A display device according to one aspect of the present disclosure includes a display section including light-emitting pixels each of which includes a light-emitting element and a drive transistor, the drive transistor including a gate electrode, a source electrode and a drain electrode, and being configured to supply a current to the light-emitting element to cause the light-emitting element to emit light; a signal line driving circuit configured to supply a signal voltage applied between the gate electrode and the source electrode of the drive transistor; and a control circuit configured to: calculate an amount of threshold voltage shift of the drive transistor on the basis of an amount of deterioration of a threshold voltage of the drive transistor during a deterioration period in which the signal voltage is kept at a value that is not zero and an amount of recovery of the threshold voltage of the drive transistor during a recovery period in which the signal voltage is kept at zero; and correct the signal voltage in accordance with the amount of threshold voltage shift.

According to this display device, the amount of threshold voltage shift of the drive transistor is calculated on the basis of not only the amount of deterioration of the threshold voltage but also the amount of recovery of the threshold voltage. This makes it possible to suppress a difference between the calculated amount of threshold voltage shift and the actual amount of threshold voltage shift. Furthermore, according to this display device, since the difference between the calculated amount of threshold voltage shift and the actual amount of threshold voltage shift is suppressed, a difference between the amount of electric current actually supplied from the drive transistor to the light-emitting element and the desired amount of electric current can be suppressed. It is therefore possible to suppress deterioration of display quality of the display device.

Furthermore, the display device according to one aspect of the present disclosure may be arranged such that the control circuit is configured to: refer to a representative deterioration curve that shows a relationship between an application time of the signal voltage and the amount of threshold voltage shift in a case where the signal voltage is a predetermined reference voltage; store, as an accumulated converted time, a value of the application time that corresponds to the amount of threshold voltage shift on the representative deterioration curve; convert a duration of the deterioration period into a converted time that is a time required for deteriorating the threshold voltage of the drive transistor by the amount of deterioration in a case where the signal voltage is the reference voltage; calculate the accumulated converted time at an end of the deterioration period by adding the converted time to the accumulated converted time at a start of the deterioration period; and calculate the amount of threshold voltage shift at the end of the deterioration period by calculating a value of the amount of threshold voltage shift that corresponds to the accumulated converted time at the end of the deterioration period on the representative deterioration curve.

According to the arrangement, by using the representative deterioration curve, the amount of deterioration accumulated in a case where an arbitrary signal voltage is applied can be expressed by a point on the curve. Furthermore, the influence of the accumulated amount of deterioration at the time of applying the signal voltage can be reflected in calculation of the amount of deterioration.

Furthermore, the display device according to one aspect of the present disclosure may be arranged such that the control circuit is configured to: calculate the amount of threshold voltage shift at an end of the recovery period by subtracting the amount of recovery from the amount of threshold voltage shift at a start of the recovery period; and calculate the accumulated converted time at the end of the recovery period by calculating a value of the application time that corresponds to the amount of threshold voltage shift at the end of the recovery period on the representative deterioration curve.

According to the arrangement, the amount of recovery is also expressed by a point on the representative deterioration curve, and therefore the amount of threshold voltage shift throughout the entire deterioration and recovery periods can be expressed by a point on the representative deterioration curve. This can simplify calculation of the accumulated amount of threshold voltage shift.

Furthermore, the display device according to one aspect of the present disclosure may be arranged such that the control circuit is configured to: convert the duration $t_d$ of the deterioration period into the converted time $t_{d_ref}$ in accordance with the following equation:

$$t_{d_ref} = \left(\frac{V_{gs_ref} - V_{th0} + V_{offset}}{V_{gs_d} - V_{th0} + V_{offset}}\right)^{-\frac{\alpha}{\beta}} t_d$$

where $t_{d_ref}$ is the converted time, $V_{gs_ref}$ is the reference voltage, $V_{gs_d}$ is the signal voltage, $V_{th0}$ is the threshold voltage of the drive transistor before application of the signal voltage, and $\alpha$, $\beta$, and $V_{offset}$ are predetermined constants; and calculate the amount of deterioration $\Delta V_{th_d}$ in accordance with the following equations:

$$\Delta V_{th_d} = A(V_{gs_ref} - V_{th0} + V_{offset})^{\alpha} t_{d_ref}^{\beta}$$

and $$A = A_0 \exp\left(-\frac{E_a}{kT}\right)$$

where $A_0$ is a constant, $E_a$ is activation energy of the threshold voltage shift, k is a Boltzmann constant, and T is temperature.

According to this arrangement, the amount of deterioration can be accurately calculated by setting the values of the constants ($\alpha$, $\beta$, $V_{offset}$, $A_0$, and $E_a$) on the basis of a result of an experiment etc.

Furthermore, the display device according to one aspect of the present disclosure may be arranged such that the control circuit is configured to calculate the amount of recovery $\Delta V_{th_r}$ in accordance with the following equations:

$$\Delta V_{th_r} = \Delta V_{th_ini} \exp\left\{-\left(\frac{t_r}{\tau}\right)^{\gamma}\right\}$$

and $$\tau = \tau_0 \exp\left(\frac{E_\tau}{kT}\right)$$

where $\Delta V_{th_ini}$ is the amount of threshold voltage shift at the start of the recovery period, $t_r$ is the duration of the recovery period, $\tau_0$ is a coefficient, $E_\tau$ is activation energy of a time constant $\tau$ of escape of a carrier from the gate insulating film of the drive transistor, k is a Boltzmann constant, T is temperature, and $\gamma$ is a predetermined constant.

According to this arrangement, the amount of recovery can be accurately calculated by setting the values of the constants ($\tau_0$, $E_\tau$, and $\gamma$) on the basis of a result of an experiment etc.

A method for driving a display device according to one aspect of the present disclosure is a display section including light-emitting pixels each of which includes a light-emitting element and a drive transistor, the drive transistor including a gate electrode, a source electrode and a drain electrode, and being configured to supply a current to the light-emitting element to cause the light-emitting element to emit light; and a signal line driving circuit configured to supply a signal voltage applied between the gate electrode and the source electrode of the drive transistor, the method comprising: calculating an amount of threshold voltage shift of the drive transistor on the basis of an amount of deterioration of a threshold voltage of the drive transistor during a deterioration period in which the signal voltage is kept at a value that is not zero and an amount of recovery of the threshold voltage of the drive transistor during a recovery period in which the signal voltage is kept at zero; and correcting the signal voltage in accordance with the amount of threshold voltage shift.

According to this method for driving a display device, the amount of threshold voltage shift of the drive transistor is calculated on the basis of not only the amount of deterioration of the threshold voltage but also the amount of recovery of the threshold voltage. It is therefore possible to suppress a difference between the calculated amount of threshold voltage shift and the actual amount of threshold voltage shift. Furthermore, according to this method for driving a display device, since the difference between the calculated amount of threshold voltage shift and the actual amount of threshold voltage shift is suppressed, it is possible to suppress a difference between the amount of electric current that is actually supplied from the drive transistor to the light-emitting element and the desired amount of electric current.

An embodiment is described below in detail with reference to the drawings. Note, however, that an unnecessarily detailed description can be omitted. For example, a detailed description of an already known matter and an overlapping explanation of a substantially identical configuration can be omitted. This is to prevent the following description from becoming unnecessarily redundant and thereby make it easier for a skilled person to understand.

The attached drawings and the following description are provided by the inventors of the present invention so that the skilled person can fully understand the present disclosure, and are not intended to limit the subject described in the claims.

Embodiment

1. Outline of Display Device

An embodiment of the present disclosure is described below with reference to the drawings.

Figure 10:
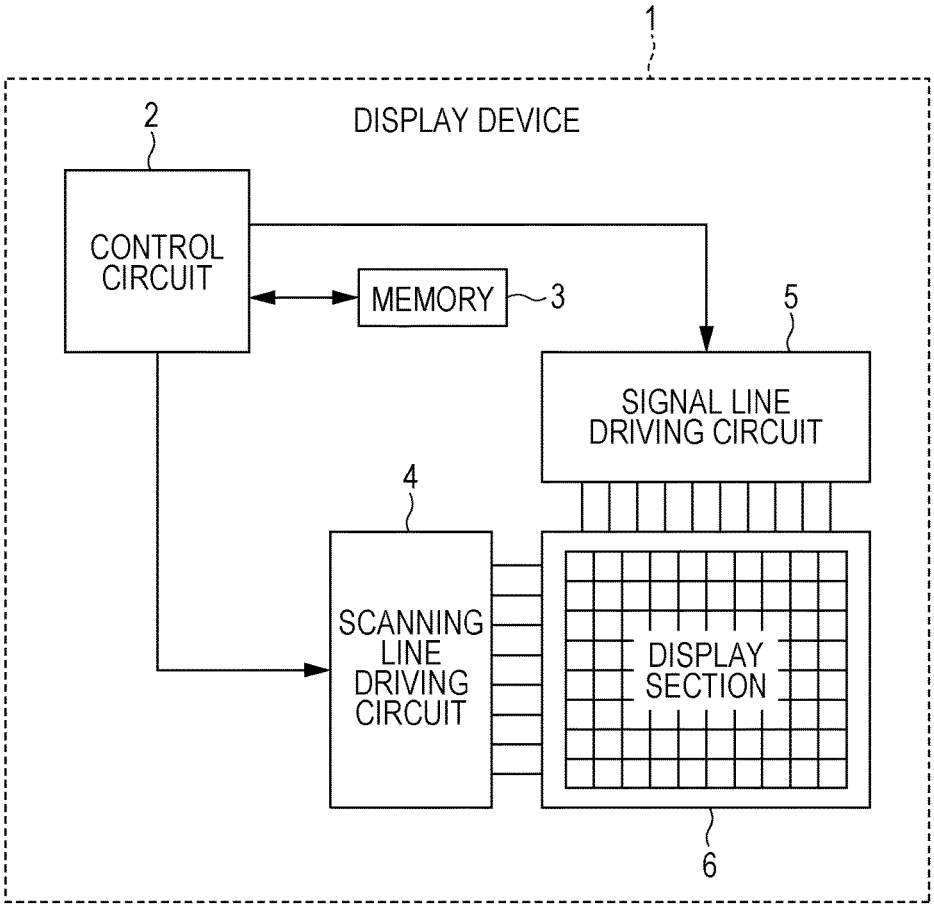
FIG. 10 is a block diagram illustrating an electrical configuration of a display device according to an embodiment.

FIG. 10 is a block diagram illustrating an electrical configuration of a display device according to the present embodiment. The display device 1 in FIG. 10 includes a control circuit 2, a memory 3, a scanning line driving circuit 4, a signal line driving circuit 5, and a display section 6.

Figure 11:
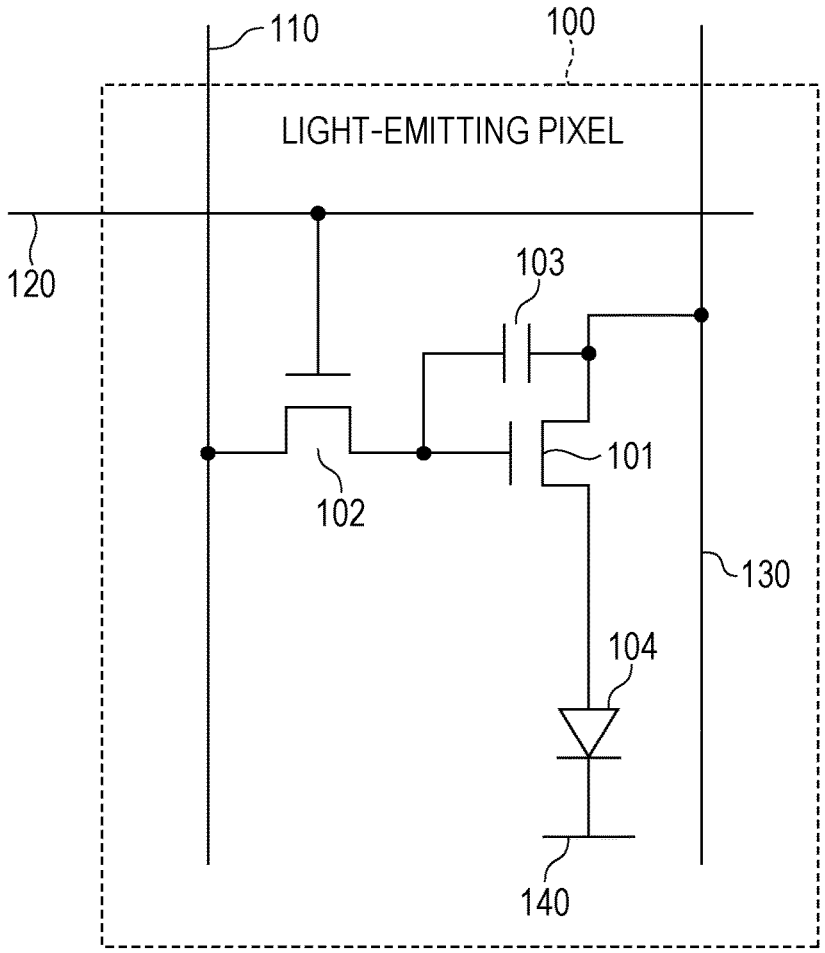
FIG. 11 is a circuit diagram illustrating a configuration of a light-emitting pixel in the display device according to the embodiment.

FIG. 11 is a view illustrating an example of a circuit configuration of a light-emitting pixel of the display section 6 of the display device 1 according to the present embodiment.

Functions etc. of the constituents elements illustrated in FIGS. 10 and 11 are described below.

The control circuit 2 controls the scanning line driving circuit 4, the signal line driving circuit 5, the display section 6, and the memory 3. The memory 3 stores therein correction data such as characteristics and accumulated stress of a drive transistor 101 of each light-emitting pixel 100. The control circuit 2 reads the correction data written to the memory 3. The control circuit 2 corrects, on the basis of the correction data, a signal voltage that is based on an externally supplied video signal, and then supplies the signal voltage thus corrected to the signal line driving circuit 5.

The display section 6 is made up of a plurality of light-emitting pixels 100 that are arranged in rows and columns and displays an image on the basis of the video signal that is externally supplied to the display device 1.

The scanning line driving circuit 4 controls conduction and non-conduction of a switching transistor 102 of each light-emitting pixel 100 by supplying a scanning signal to scanning lines 120 provided in the rows of the display section 6.

The signal line driving circuit 5 is connected to signal lines 110 provided in the columns of the display section 6 and supplies a signal voltage that is based on the video signal to the light-emitting pixels 100.

Light emission of the light-emitting pixels 100 is controlled by signals supplied from the scanning line driving circuit 4 and the signal line driving circuit 5. As illustrated in FIG. 11, each of the light-emitting pixels 100 includes a drive transistor 101, a switching transistor 102, a capacitor 103, an organic EL element 104, a signal lines 110, a scanning line 120, a power source line 130, and a common electrode 140.

The drive transistor 101 is a driving element. A gate electrode of the drive transistor 101 is connected to one electrode of the capacitor 103, a source electrode of the drive transistor 101 is connected to an anode electrode of the organic EL element 104, a drain electrode of the drive transistor 101 is connected to the other electrode of the capacitor 103 and to the power source line 130. The drive transistor 101 converts a voltage corresponding to the signal voltage applied between the gate and the source into a drain electric current corresponding to the signal voltage, and then supplies, as a signal electric current, this drain electric current to the organic EL element 104. The drive transistor 101 is, for example, an n-type TFT.

The switching transistor 102 is a switching element. A gate electrode of the switching transistor 102 is connected to the scanning line 120, one of source and drain electrodes of the switching transistor 102 is connected to the gate electrode of the drive transistor 101, and the other one of the source and drain electrodes of the switching transistor 102 is connected to the signal line 110.

The capacitor 103 is a capacitive element. A first electrode of the capacitor 103 is connected to the gate electrode of the drive transistor 101, and a second electrode of the capacitor 103 is connected to the drain electrode of the drive transistor 101. The capacitor 103 retains an electric charge corresponding to the signal voltage supplied from the signal line 110. For example, the capacitor 103 retains the last gate voltage even after the switching transistor 102 is shifted to a non-conduction state, and continuously supplies a driving electric current from the drive transistor 101 to the organic EL element 104.

The organic EL element 104 is a light-emitting element. A cathode electrode of the organic EL element 104 is connected to the common electrode 140, and an anode electrode of the organic EL element 104 is connected to the source electrode of the drive transistor 101. The organic EL element 104 emits light in accordance with the electric current supplied from the drive transistor 101.

The signal line 110 connects the signal line driving circuit 5 and light-emitting pixels 100 belonging to a pixel column including the light-emitting pixel 100. The signal line 110 supplies a signal voltage that is based on a video signal to each pixel.

The scanning line 120 connect the scanning line driving circuit 4 and light-emitting pixels 100 belonging to a pixel row including the light-emitting pixel 100. With this arrangement, the scanning line 120 supplies a timing at which the signal voltage is written, to each of the light-emitting pixels 100 belonging to the pixel row including the light-emitting pixel 100.

The power source line 130 is a line for applying a voltage to the drain electrode of the drive transistor 101.

The common electrode 140 is an electrode for applying a voltage to the cathode electrode of the organic EL element 104.

Next, a light emitting operation of the organic EL element 104 of the light-emitting pixel 100 illustrated in FIG. 11 is described.

The signal voltage supplied from the signal line driving circuit 5 is applied to the gate electrode of the drive transistor 101 via the switching transistor 102. The drive transistor 101 causes an electric current corresponding to the signal voltage applied to the gate electrode to flow between the source and the drain. This source-drain electric current flows to the organic EL element 104. As a result, the organic EL element 104 emits light at light emission luminance corresponding to the source-drain electric current.

The principle of light emission of the organic EL element 104 of each of the light-emitting pixels 100 is as described above. Next, an operation performed in a case where an image is displayed by the display section 6 that is made up of the plurality of light-emitting pixels 100 is described.

The signal line driving circuit 5 supplies a signal voltage to all of the signal lines 110 for a certain period. During this output period, the scanning line driving circuit 4 supplies a scanning signal to the scanning lines 120 in one row. Upon receipt of the scanning signal, the switching transistors 102 of the light-emitting pixels 100 in this row become conductive. Then, the signal voltage supplied to the signal lines 110 is applied to the gate electrodes of the drive transistors 101 of these light-emitting pixels 100. Since source-drain electric currents of the drive transistors 101 are controlled in accordance with the magnitude of the signal voltage, the organic EL elements 104 emit light in accordance with this amount of electric current. The light emission continues for 1 frame until next supply of a scanning signal to the scanning lines 120 in this row.

During a period from the time when the scanning line driving circuit 4 supplies a scanning signal to the scanning lines 120 in one row to the time when the scanning line driving circuit 4 supplies a scanning signal to the scanning lines 120 in a next row, the signal line driving circuit 5 supplies a next signal voltage to all of the signal lines 110. As in the case of the light-emitting pixels 100 in the previous row, the signal voltage is applied to gate electrodes of the drive transistors 101 of the light-emitting pixels 100 in the next row at a timing when the scanning signal is supplied. Then, the organic EL element 104 emits light for 1 frame period by a signal electric current corresponding to the signal voltage.

Every time the signal line driving circuit 5 supplies a signal voltage to the signal lines 110 and the scanning line driving circuit 4 supplies a scanning signal to the scanning lines 120, the organic EL elements 104 of the light-emitting pixels 100 in a row to which the scanning signal has been supplied emit light for 1 frame period in a similar manner to that described above.

As described above, the organic EL elements 104 of the entire display section 6 emit light at luminance according to the magnitude of supplied signal voltages at different timings, and thus the display section 6 displays an image as a whole.

In a case where light emission of the organic EL elements 104 is stopped, the control circuit 2 sets a signal voltage supplied to the signal lines 110 to zero and also sets a voltage applied between a gate and a source of the drive transistor 101 to zero.

2. Correction of Threshold Voltage Shift

As described above, light emission of the organic EL elements 104 of the display device 1 is controlled. However, since the threshold voltage of the drive transistor 101 shifts as illustrated in FIG. 9, a signal voltage need be corrected in order that the organic EL elements 104 emit light at desired luminance. A method for calculating the amount of threshold voltage shift and a method for correcting a signal voltage on the basis of the amount of threshold voltage shift are described below.

2-1. Method for Calculating Amount of Deterioration of Threshold Voltage

Figure 12:
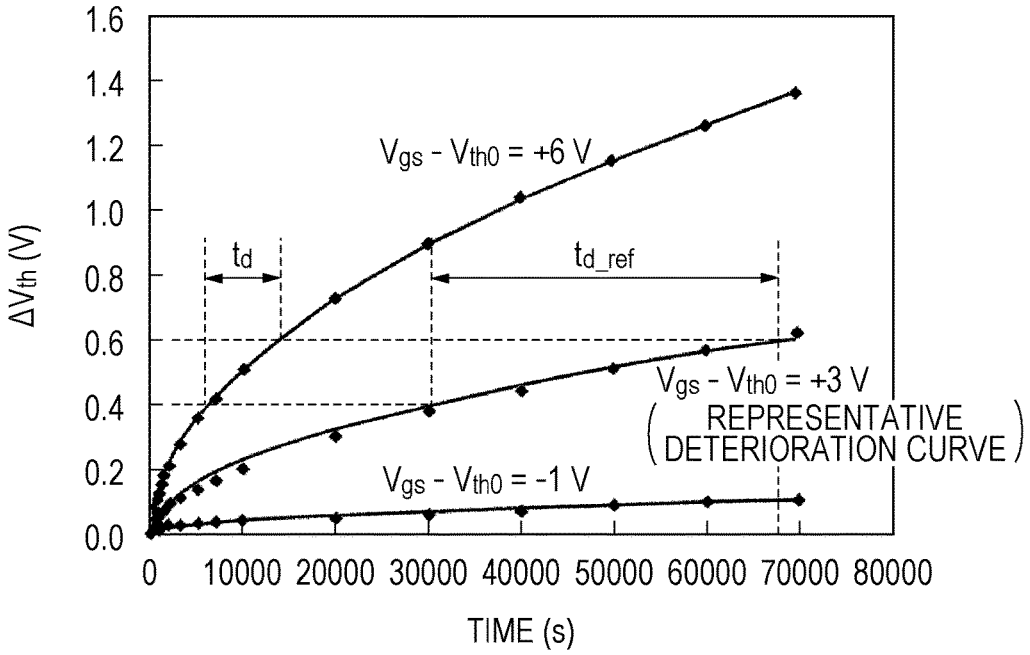
FIG. 12 is a graph illustrating how the amount of deterioration of the threshold voltage is related to the duration of a deterioration period.

First, a method for calculating the amount of threshold voltage shift (hereinafter referred to as "the amount of deterioration") during a period in which a signal voltage applied to the drive transistor 101 is kept at a value that is not zero (hereinafter referred to as a "deterioration period") is described with reference to FIG. 12. FIG. 12 is a graph illustrating how the amount of deterioration $\Delta V_{th}$ of the threshold voltage is related to the duration $t_d$ of the deterioration period in a case where a predetermined voltage $V_{gs}$ is applied to the gate and the source of the drive transistor 101 including a semiconductor layer made up of an oxide semiconductor. FIG. 12 illustrates three experimental results in which a voltage obtained by subtracting an initial threshold voltage $V_{th0}$ (a threshold voltage before application of stress) of the drive transistor 101 from the gate-source voltage $V_{gs}$ of the drive transistor 101 is +6 V, +3 V and −1 V.

The following describes a method for expressing, by a function, the amount of deterioration $\Delta V_{th_d}$ of the threshold voltage of the drive transistor 101 by fitting the graph concerning the experimental results illustrated in FIG. 12 (by applying a non-linear function). In general, in a case where a certain voltage is applied to a gate and a source of a TFT, the amount of deterioration $\Delta V_{th_d}$ of the threshold voltage is expressed by the following equation 1:

$$\Delta V_{th_d} = (V_{gs} - V_{th0})\left[1 - \exp\left\{-\left(\frac{t_d}{\tau}\right)^{\beta}\right\}\right] \quad \text{equation 1}$$

where $V_{gs}$ is the gate-source voltage, $t_d$ is the duration of a deterioration period, $V_{th0}$ is an initial threshold voltage (a threshold voltage before application of stress), $\tau$ is a time constant, and $\beta$ is a constant. The equation 1 expresses the amount of deterioration in a case where $V_{gs}$ is kept at a certain value. In the equation 1, a function which causes the amount of deterioration to gradually approach $V_{gs}-V_{th0}$ as the duration $t_d$ of the deterioration period becomes larger is used. However, in the drive transistor 101 of the display device 1, in a case where a signal voltage is constant, the gate-source voltage $V_{gs}$ is not kept at a constant value in order to keep the drain-source electric current at an almost constant value. That is, since a voltage that has been corrected in accordance with the amount of threshold voltage shift (the amount of deterioration) is applied between the gate and the source, $V_{gs}$ is a voltage value that changes in accordance with the amount of threshold voltage shift (the amount of deterioration). In view of this, the equation 1 is transformed to the following equation suitable for a case where the drain-source electric current is kept at an almost constant value by expanding the right side of the equation 1 by Maclaurin expansion:

$$\Delta V_{th_d} = A(V_{gs} - V_{th0} + V_{offset})^{\alpha} t_d^{\beta} \quad \text{equation 2}$$

In the equation 2, A, $\alpha$, $\beta$ and $V_{offset}$ are constants obtained by fitting the graph concerning the experimental results illustrated in FIG. 12.

Based on the equation 2, the amount of deterioration $\Delta V_{th_d}$ in a case where the predetermined gate-source voltage $V_{gs}$ is applied over a predetermined deterioration period (duration $t_d$) can be calculated.

As described above, the drain-source electric current is kept almost constant in a case where the signal voltage is constant. However, typically, the signal voltage is not necessarily constant in the display device 1. Therefore, in a case where the signal voltage fluctuates, the amounts of deterioration in the cases of application of such signal voltages need be calculated by the equation 2. Furthermore, even in a case where the same gate-source voltage $V_{gs}$ is applied, the amount of deterioration varies depending on the degree of deterioration of the drive transistor 101 at the time of the application (that is, the accumulated amount of deterioration). In view of this, the influence of the accumulated amount of deterioration is also reflected in calculating the amount of deterioration occurring in a case where an arbitrary gate-source voltage is applied for a predetermined time. For this purpose, a representative deterioration curve representing the amount of deterioration with respect to the duration of the deterioration period obtained in a case where a reference voltage $V_{gs_ref}$ is applied between the gate and the source is used. That is, the time axis of the graph illustrated in FIG. 12 that shows the amount of deterioration with respect to the duration of the deterioration period obtained in a case where an arbitrary gate-source voltage is applied is converted so as to match the representative deterioration curve. For example, in FIG. 12, the deterioration curve in the case of $V_{gs}-V_{th0}$=+3 V is selected as the representative deterioration curve. Here, a case where the state of $V_{gs}-V_{th0}$=+6 V is maintained for the duration $t_d$ of the deterioration period and the amount of threshold voltage shift deteriorates from 0.4 V to 0.6 V is considered. In this case, this duration $t_d$ of the deterioration period is converted into a converted time $t_{d_ref}$ which it takes for the threshold voltage to deteriorate from 0.4 V to 0.6 V on the representative deterioration curve.

In this way, the amount of deterioration occurring in a case where an arbitrary gate-source voltage is applied over the duration $t_d$ of the deterioration period is calculated as the amount of deterioration occurring in a case where the reference voltage is applied over a converted time. This makes it possible to express, on the representative deterioration curve, the amount of deterioration occurring in the case where an arbitrary gate-source voltage is applied.

A method for calculating the converted time $t_{d_ref}$ is described below. Based on the equation 2, the amount of deterioration $\Delta V_{th_ref}$ occurring in the case where the reference voltage $V_{gs_ref}$ applied over the converted time $t_{d_ref}$ is expressed as follows:

$$\Delta V_{th_ref} = A(V_{gs_ref} - V_{th0} + V_{offset})^{\alpha} t_{d_ref}^{\beta} \quad \text{equation 3}$$

Accordingly, assume that the amount of deterioration $\Delta V_{th_ref}$ is equal to the amount of deterioration $\Delta V_{th_d}$ (that is expressed by the equation 2) occurring in a case where an arbitrary gate-source voltage $V_{gs}$ is applied for the time $t_d$, the converted time $t_{d_ref}$ is expressed as follows based on the equations 2 and 3:

$$t_{d_ref} = \left(\frac{V_{gs_ref} - V_{th0} + V_{offset}}{V_{gs_d} - V_{th0} + V_{offset}}\right)^{-\frac{\alpha}{\beta}} t_d \quad \text{equation 4}$$

This makes it possible to convert the duration $t_d$ of the deterioration period into the converted time $t_{d_ref}$. Therefore, even in a case where the gate-source voltage fluctuates, the amount of deterioration can be expressed only by the representative deterioration curve by converting the duration $t_d$ of the deterioration period into the converted time $t_{d_ref}$. Note that the accumulated amount of deterioration is calculated by calculating the accumulated converted time which is sum of the converted times $t_{d_ref}$ and finding the amount of threshold voltage shift at a point on the representative deterioration curve that corresponds to the accumulated converted time.

2-2. Method for Calculating Amount of Recovery of Threshold Voltage

Next, a method for calculating the amount of threshold voltage shift (hereinafter referred to as "the amount of recovery") during a period in which a signal voltage applied between the gate and the source of the drive transistor 101 is kept at zero (hereinafter referred to as a "recovery period") is described. Based on the graph as illustrated in FIG. 8 that shows a relationship between the amount of recovery of the threshold voltage of the drive transistor 101 and the duration of the recovery period, the amount of recovery $\Delta V_{th_r}$ can be expressed as follows:

$$\Delta V_{th_r} = \Delta V_{th_ini} \exp\left\{-\left(\frac{t_r}{\tau}\right)^{\gamma}\right\} \quad \text{equation 5}$$

where $\Delta V_{th_ini}$ is the amount of threshold voltage shift at the start of the recovery period and $t_r$ is the duration of the recovery period.

Here, the time constant $\tau$ is expressed as follows:

$$\tau = \tau_0 \exp\left(\frac{E_\tau}{kT}\right) \quad \text{equation 6}$$

where $\tau 0$ is a coefficient, $E_\tau$ is activation energy of the time constant $\tau$ of escape of a carrier from the gate insulating film of the drive transistor 101, k is a Boltzmann constant, and T is temperature. Here, $\gamma$ in the equation 5 is a constant obtained from the experimental result.

Therefore, the amount of recovery at the end of the recovery period can be obtained based on the equations 5 and 6.

2-3. Calculation of Correction Amount Using Representative Deterioration Curve

Figure 13:
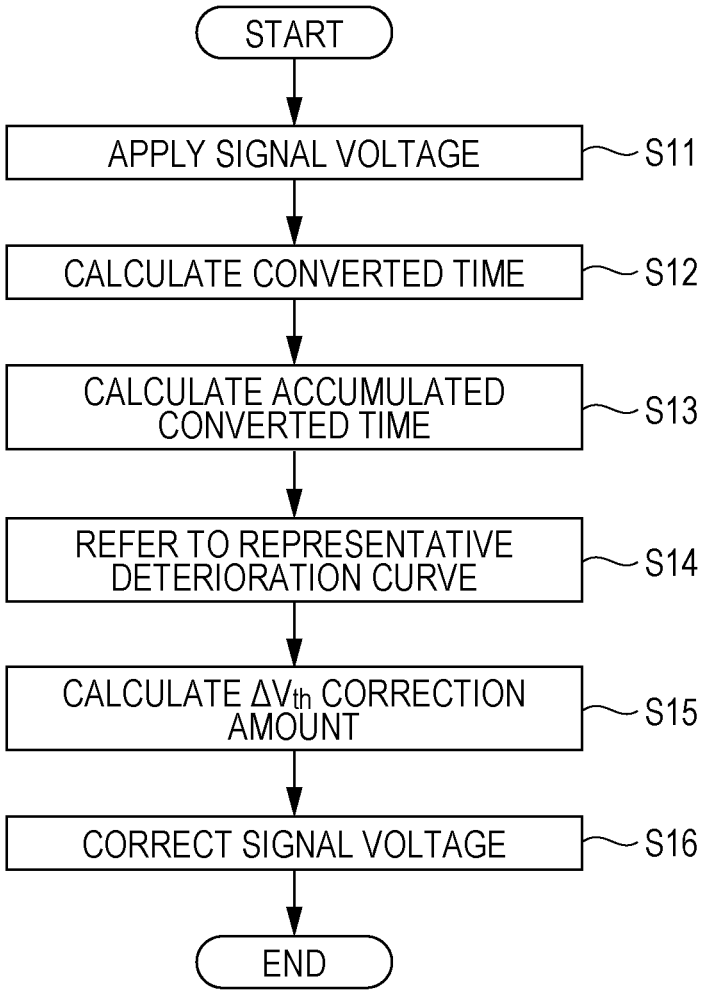
FIG. 13 is a flowchart illustrating how a control circuit operates in a case where a signal voltage is applied to a drive transistor.
Figure 14:
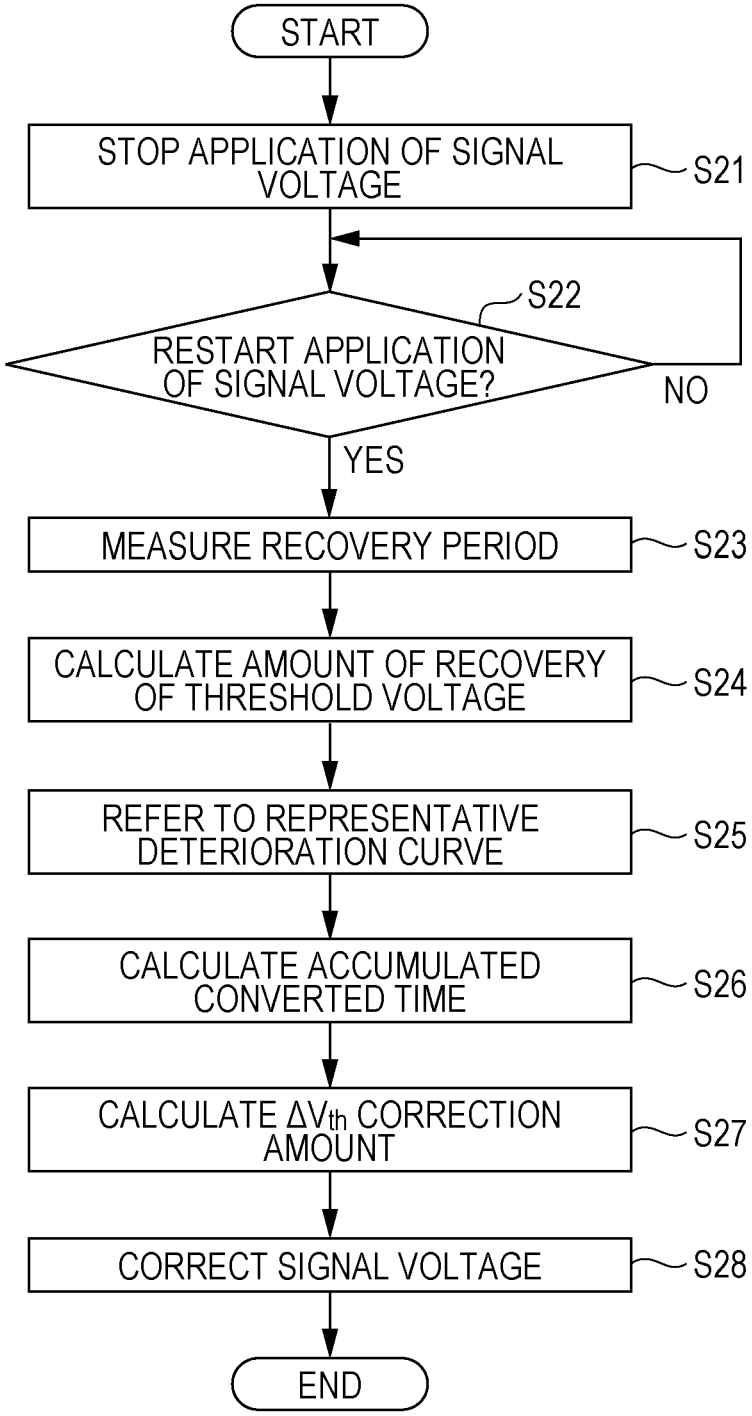
FIG. 14 is a flowchart illustrating how the control circuit operates in a case where no signal voltage is applied to the drive transistor.
Figure 15:
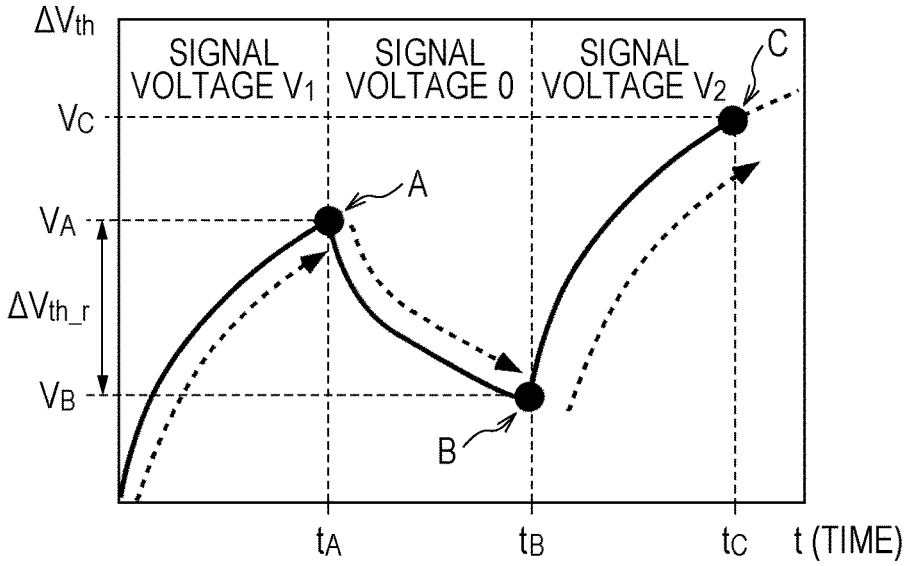
FIG. 15 is a graph illustrating an outline of how the amount of threshold voltage shift changes with passage of time in a case where the signal voltage applied to the drive transistor fluctuates.
Figure 16:
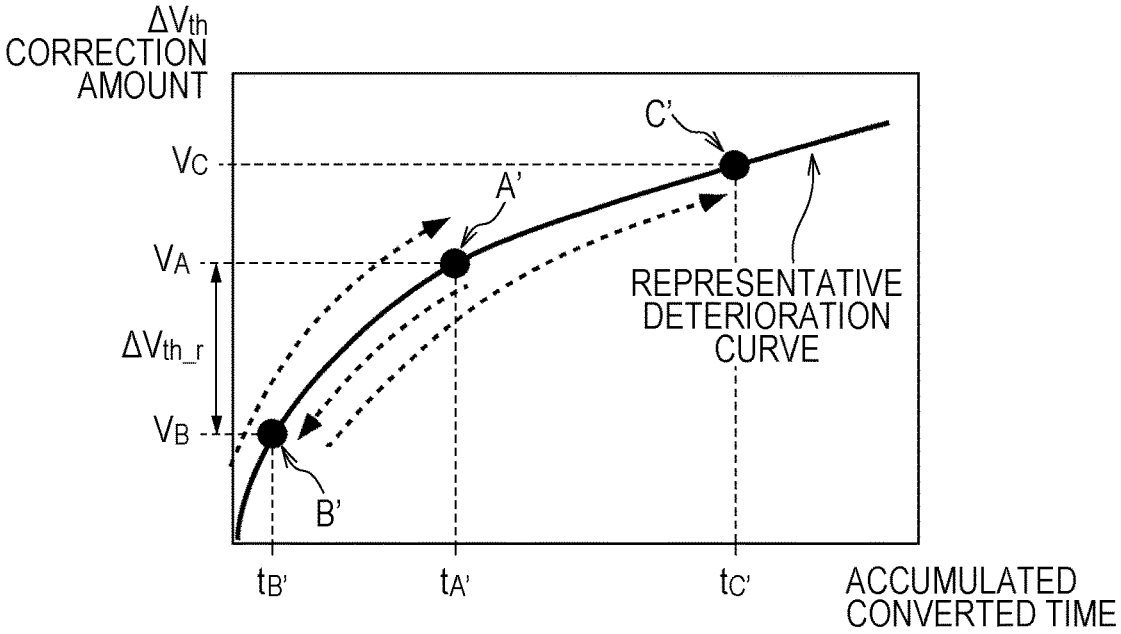
FIG. 16 is a schematic view illustrating how a point on the representative deterioration curve moves in a case where the signal voltage applied to the drive transistor fluctuates.

Next, a method for calculating the amount of deterioration and the amount of recovery by using the representative deterioration curve is described with reference to FIGS. 13 to 16. FIG. 13 is a flowchart illustrating how the control circuit 2 operates in a case where a signal voltage is applied to the drive transistor 101. FIG. 14 is a flow chart illustrating how the control circuit 2 operates in a case where no signal voltage is applied to the drive transistor 101. FIG. 15 is a graph illustrating an outline of how the amount of threshold voltage shift changes over time in a case where a signal voltage applied to the drive transistor 101 fluctuates. FIG. 16 is a schematic view illustrating how a point on the representative deterioration curve moves in a case where a signal voltage applied to the drive transistor 101 fluctuates as illustrated in FIG. 15.

First, the procedure of the operation of the control circuit 2 performed in a case where a signal voltage is applied to the signal lines 110 is described with reference to the flowchart of FIG. 13. When a signal voltage is applied to the signal lines 110 (S11), the signal voltage is applied between the gate and the source of the drive transistor 101 for 1 frame period. When the signal voltage is applied to the signal lines 110, the control circuit 2 calculates a converted time corresponding to 1 frame period on the basis of the gate-source voltage and a reference voltage in accordance with the equation 4 (S12). After calculating the converted time, the control circuit 2 calculates an accumulated converted time at the end of application of the signal voltage by adding the converted time thus calculated to an accumulated converted time at the start of application of the signal voltage (S13). After calculating the accumulated converted time, the control circuit 2 refers to the representative deterioration curve stored in the memory 3 (S14). And the control circuit 2 calculates a correction amount of the threshold voltage by calculating a value (a value of the vertical axis of the graph of FIG. 12) of the amount of threshold voltage shift at a point on the representative deterioration curve that corresponds to the accumulated converted time (a value of the horizontal axis of the graph of FIG. 12) (S15). Based on the correction amount calculated through the above procedure, the control circuit 2 corrects the signal voltage (S16).

The operation procedure described above is described below with reference to FIGS. 15 and 16. For example, assume that a signal voltage $V_1$ is applied during a period from a time t=0 to a time $t=t_A$ as illustrated in the graph of FIG. 15, the control circuit 2 converts the duration $t_A$ of the deterioration period into a converted time $t_{A'}$ on the basis of the equation 4. In this case, application of the signal voltage starts from the time t=0, and therefore an accumulated converted time at the start of the deterioration period is zero. Accordingly, an accumulated converted time at the end of application of the signal voltage is $0+t_{A'}=t_{A'}$. Then, the control circuit 2 calculates a correction amount $V_A$ of a threshold voltage on the basis of a value on the vertical axis of a point (A') whose value on the horizontal axis is the accumulated converted time $t_{A'}$ by referring to the representative deterioration curve illustrated in FIG. 16. In this way, the control circuit 2 calculates the correction amount $V_A$ of the threshold voltage at the end of the deterioration period.

Next, the procedure of the operation of the control circuit 2 performed in a case where no signal voltage is applied to the signal lines 110 (in a case where a signal voltage is zero) is described with reference to the flowchart of FIG. 14. For example, in a case where the display device 1 is powered off, the control circuit 2 sets a signal voltage applied to the signal lines 110 to zero (S21). In the case where the display device 1 is powered off, there is a possibility that an electric charge of the capacitor 103 illustrated in FIG. 11 remains without being discharged, and a gate-source voltage of the drive transistor 101 does not become zero. Therefore, in order to set the gate-source voltage of the drive transistor 101 to zero with certainty, the electric charge of the capacitor 103 may be discharged by causing the switching transistor 102 to be in a conductive state after setting a signal voltage supplied to the signal lines 110 to zero immediately before the display device 1 is powered off.

In a case where the state where the signal voltage is zero ends and application of a signal voltage to the signal lines 110 restarts (Yes in S22), the control circuit 2 measures the duration of a recovery period in which the signal voltage is kept at zero (S23). The control circuit 2 calculates the amount of recovery $\Delta V_{th_r}$ of the threshold voltage on the basis of the amount of threshold voltage shift at the start of the recovery period (the correction amount of the threshold voltage) and the duration of the recovery period thus measured, by using the equations 5 and 6 (S24). The control circuit 2 calculates the amount of threshold voltage shift at the end of the recovery period by subtracting the calculated amount of recovery $\Delta V_{th_r}$ from the amount of threshold voltage shift at the start of the recovery period. After calculating the amount of threshold voltage shift at the end of the recovery period, the control circuit 2 refers to the representative deterioration curve (S25) and calculates an accumulated converted time corresponding to the amount of threshold voltage shift at the end of the recovery period (S26). Then, the control circuit 2 calculates, from the accumulated converted time, a correction amount (the amount of threshold voltage shift) of the threshold voltage at the end of the recovery period (S27), and corrects a signal voltage on the basis of the correction amount of the threshold voltage thus calculated (S28). Note that the amount of threshold voltage shift at the end of the recovery period may be calculated from the accumulated converted time as described above or a value calculated from the amount of threshold voltage shift at the start of the recovery period and the amount of recovery may be stored.

The above-described procedure of the operation performed in the case where no signal voltage is applied is described with reference to FIGS. 15 and 16. For example, in a case where the control circuit 2 keeps the signal voltage at zero from the time $t=t_0$ to a time $t=t_B$ as illustrated in the graph of FIG. 15, the amount of threshold voltage shift recovers from $V_A$ to $V_B$ by the amount of recovery $\Delta V_{th_r}$. Therefore, the control circuit 2 calculates the amount of recovery $\Delta V_{th_r}$ of the threshold voltage by using the equations 5 and 6. Then, the control circuit 2 calculates, as an accumulated converted time at the end of the recovery period, a value $t_{B'}$ on the representative deterioration curve of a point B' at which the amount of threshold voltage shift is $V_B$ (a value that has decreased from $V_A$ by $\Delta V_{th_r}$) with reference to the representative deterioration curve as illustrated in FIG. 16. In this way, the control circuit 2 calculates the accumulated converted time at the end of the recovery period and the correction amount of the threshold voltage (the amount of threshold voltage shift), and then corrects the signal voltage.

As described above, in a case where the example illustrated in FIGS. 15 and 16 is used, the amount of recovery of the threshold voltage during the recovery period (from $t_A$ to $t_B$) can be also expressed by movement of a point on the representative deterioration curve. Furthermore, even in a case where a deterioration period (a period from the value $t_B$ of the point B on the time axis to the value $t_C$ of the point C on the time axis in FIG. 15) in which a signal voltage $V_2$ is applied follows after the end of the recovery period, the amount of threshold voltage shift at the end of the deterioration period can be calculated on the basis of the representative deterioration curve. That is, an accumulated converted time $t_{C'}$ at the end $t_C$ of the deterioration period is calculated by converting the duration $(t_C-t_B)$ of the deterioration period illustrated in FIG. 15 into a converted time $(t_{C'}-t_{B'})$ illustrated in FIG. 16. Then, the amount of threshold voltage shift $V_C$ at the end of the deterioration period can be calculated from a value on the vertical axis of the point C' on the representative deterioration curve that corresponds to the accumulated converted time $t_{C'}$.

In this way, a threshold voltage shift in a deterioration period and a recovery period can be calculated by using a representative deterioration curve.

2.4 Correction of Signal Voltage

Next, a method for correcting a signal voltage on the basis of the amount of threshold voltage shift calculated as described above is described below.

The control circuit 2 corrects a signal voltage by offsetting the signal voltage by the calculated amount of threshold voltage shift. More specifically, the control circuit 2 calculates the amount of threshold voltage shift that corresponds to an accumulated converted time at the start of application of a signal voltage from the signal line driving circuit 5 to the signal lines 110 with reference to the representative deterioration curve. Then, the control circuit 2 offsets the signal voltage in accordance with the amount of threshold voltage shift thus calculated.

2.5 Effects Etc.

As described above, the control circuit 2 of the display device 1 according to the present embodiment calculates the amount of threshold voltage shift of the drive transistor 101 on the basis of the amount of deterioration of the threshold voltage of the drive transistor 101 during the deterioration period and the amount of recovery of the drive transistor 101 during the recovery period. Then, the control circuit 2 corrects a signal voltage on the basis of the amount of threshold voltage shift. This suppresses a difference between the calculated amount of threshold voltage shift and the actual amount of threshold voltage shift. Furthermore, since the difference between the calculated amount of threshold voltage shift and the actual amount of threshold voltage shift is suppressed, it is possible to suppress a difference between the amount of electric current actually supplied from the drive transistor 101 to the organic EL element 104 and the desired amount of electric current. This makes it possible to suppress deterioration of display quality of the display device 1.

Furthermore, the control circuit 2 of the display device 1 according to the present embodiment can express, by a point on a single representative deterioration curve, the amount of deterioration accumulated in a case where an arbitrary signal voltage is applied by using the single representative deterioration curve. Furthermore, the influence of the accumulated amount of deterioration at the time of application of a signal voltage can be reflected in calculation of the amount of deterioration.

Furthermore, since the control circuit 2 of the display device 1 according to the present embodiment also expresses the amount of recovery by a point on the representative deterioration curve, the amount of threshold voltage shift throughout the entire deterioration and recovery periods can be expressed by a point on the representative deterioration curve. This makes it possible to further simplify calculation of the accumulated amount of threshold voltage shift.

Furthermore, since the control circuit 2 of the display device 1 according to the present embodiment calculates the amount of deterioration by using the equations 3 and 4 that are obtained on the basis of the result of the experiment, it is possible to accurately calculate the amount of deterioration.

Furthermore, since the control circuit 2 of the display device 1 according to the present embodiment calculates the amount of recovery by using the equations 5 and 6 that are obtained on the basis of the result of the experiment, it is possible to accurately calculate the amount of recovery.

Other Embodiments

An embodiment has been described so far as an example of the technique disclosed in the present application. However, the technique of the present disclosure is not limited to this, and is also applicable to embodiments in which an appropriate change, substitution, addition, or omission is made.

For example, A in the equation 2 is a constant, but A may be a function of the temperature in order to express temperature dependency of the amount of deterioration. For example, A may be expressed by the following equation.

$$A = A_0 \exp\left(-\frac{E_a}{kT}\right) \quad \text{equation 7}$$

where $A_0$ is a constant, and $E_a$ is activation energy of a threshold voltage shift.

In addition, the amount of deterioration and the amount of recovery of a threshold voltage shift may be accurately calculated in accordance with a change of measured temperature over time by adding a function of measuring the temperature T to the display device.

In the above embodiment, an arrangement in which an n-type TFT is used as a drive transistor is employed. However, similar effects to those of the above embodiment can also be produced in a display device which employs an arrangement in which a p-type TFT is used as a drive transistor and polarities of power source lines etc. are inverted.

In the above embodiment, an example of a circuit of a light-emitting pixel in the display device has been described. However, the circuit of the light-emitting pixel is not limited to the above example. Any light-emitting pixel that controls an electric current supplied to a light-emitting element by adjusting a voltage applied between a gate and a source of a drive transistor can be used.

In the above embodiment, an example of a circuit of a light-emitting pixel in the display device has been described. However, the circuit of the light-emitting pixel is not limited to the above example. Any light-emitting pixel that has a function of compensating a threshold voltage shift of a drive transistor in a circuit of the light-emitting pixel can be used. This makes it possible to supply a desired amount of electric current to the light-emitting element by offsetting a video signal voltage by the amount of shortage of compensation even in a case where a threshold voltage shift cannot be sufficiently compensated only in a pixel circuit because of insufficient compensation accuracy.

In the above embodiment, an example in which a converted time corresponding to 1 frame period is calculated in the step of correcting a threshold voltage of a drive transistor (S12) has been described. However, the calculation rate of the converted time is not limited to the above example. Any calculation rate of the converted time that is not longer than 1 frame period or not shorter than 1 frame period can be used.

In the above embodiment, an organic EL element is used as a light-emitting element. However, any light-emitting element can be used, provided that it is a light-emitting element whose light emission intensity changes depending on the electric current.

The above display device can be used as a flat panel display and is applicable to all kinds of electronic apparatuses, such as a television set, a personal computer, and a mobile phone, which have a display device.

The embodiments have been described so far as example of the technique of the present disclosure. For this purpose, the attached drawings and the detailed description have been provided.

Therefore, the constituent elements described in the attached drawings and the detailed description may include not only constituent elements that are essential for solution of the problems, but also constituent elements for illustrative purpose that are not essential for solution of the problems. It should not therefore be acknowledged that such non-essential constituent elements are essential, just by the fact that such non-essential constituent elements are described in the attached drawings and the detailed description.

The above embodiments are provided for the purpose of illustration of the technique of the present disclosure, and therefore various changes, substitutions, additions, omissions, etc. can be made within the scope of the claims and the scope of equivalents thereof.

The present disclosure is applicable to a display device and a method for driving a display device, and is applicable especially to a display device such as a television set.

What is claimed is:

1. A display device, comprising:

a display including light-emitting pixels each of which includes a light-emitting element and a drive transistor, the drive transistor including a gate electrode, a source electrode and a drain electrode, and being configured to supply a current to the light-emitting element to cause the light-emitting element to emit light;

a signal line driving circuit configured to supply a signal voltage applied between the gate electrode and the source electrode of the drive transistor;

a memory that stores correction data including a representative drive transistor threshold voltage deterioration curve, characteristics of the drive transistor of each light-emitting pixel, and an accumulated stress of the drive transistor of each light-emitting pixel; and a control circuit configured to calculate, using the correction data stored in the memory, an amount of threshold voltage shift of the drive transistor on the basis of an amount of deterioration of a threshold voltage of the drive transistor during a deterioration period in which the signal voltage is kept at a value that is not zero and an amount of recovery of the threshold voltage of the drive transistor during a recovery period in which the signal voltage is kept at zero;

refer to a representative deterioration curve that shows a relationship between an application time of the signal voltage and the amount of threshold voltage shift in a case where the signal voltage is a predetermined reference voltage;

store, as an accumulated converted time, a value of the application time that corresponds to the amount of threshold voltage shift on the representative deterioration curve;

convert a duration of the deterioration period into a converted time that is a time required for deteriorating the threshold voltage of the drive transistor by the amount of deterioration in a case where the signal voltage is the reference voltage;

calculate the accumulated converted time at an end of the deterioration period by adding the converted time to the accumulated converted time at a start of the deterioration period;

calculate the amount of threshold voltage shift at the end of the deterioration period by calculating a value of the amount of threshold voltage shift that corresponds to the accumulated converted time at the end of the deterioration period on the representative deterioration curve; and correct the signal voltage in accordance with the amount of threshold voltage shift.

2. The display device according to claim 1, wherein the control circuit is configured to:

calculate the amount of threshold voltage shift at an end of the recovery period by subtracting the amount of recovery from the amount of threshold voltage shift at a start of the recovery period; and calculate the accumulated converted time at the end of the recovery period by calculating a value of the application time that corresponds to the amount of threshold voltage shift at the end of the recovery period on the representative deterioration curve.

3. The display device according to claim 1, wherein the control circuit is configured to:

convert the duration $t_d$ of the deterioration period into the converted time $t_{d_ref}$ in accordance with the following equation:

$$t_{d_ref} = \left(\frac{V_{gs_ref} - V_{th0} + V_{offset}}{V_{gs_d} - V_{th0} + V_{offset}}\right)^{-\frac{\alpha}{\beta}} t_d$$

where $t_{d_ref}$ is the converted time, $V_{gs_ref}$ is the reference voltage, $V_{gs_d}$ is the signal voltage, $V_{th0}$ is the threshold voltage of the drive transistor before application of the signal voltage, and α, β, and $V_{offset}$ are predetermined constants; and calculate the amount of deterioration $\Delta V_{th_d}$ in accordance with the following equations:

$$\Delta V_{th_d} = A(V_{gs_ref} - V_{th0} + V_{offset})^{\alpha} t_{d_ref}^{\beta}$$

and $$A = A_0 \exp\left(-\frac{E_a}{kT}\right)$$

where $A_0$ is a constant, $E_a$ is activation energy of the threshold voltage shift, k is a Boltzmann constant, and T is temperature.

4. A display device, comprising:

a display including light-emitting pixels each of which includes a light-emitting element and a drive transistor, the drive transistor including a gate electrode, a source electrode and a drain electrode, and being configured to supply a current to the light-emitting element to cause the light-emitting element to emit light;

a signal line driving circuit configured to supply a signal voltage applied between the gate electrode and the source electrode of the drive transistor;

a memory that stores correction data including a representative drive transistor threshold voltage deterioration curve, characteristics of the drive transistor of each light-emitting pixel, and an accumulated stress of the drive transistor of each light-emitting pixel; and a control circuit configured to calculate, using the correction data stored in the memory, an amount of threshold voltage shift of the drive transistor on the basis of an amount of deterioration of a threshold voltage of the drive transistor during a deterioration period in which the signal voltage is kept at a value that is not zero and an amount of recovery of the threshold voltage of the drive transistor during a recovery period in which the signal voltage is kept at zero;

calculate the amount of recovery $\Delta V_{th_r}$ in accordance with the following equations:

$$\Delta V_{th_r} = \Delta V_{th_ini} \exp\left\{-\left(\frac{t_r}{\tau}\right)^{\gamma}\right\}$$

and $$\tau = \tau_0 \exp\left(\frac{E_\tau}{kT}\right)$$

where $\Delta V_{th_ini}$ is the amount of threshold voltage shift at the start of the recovery period, $t_r$ is a duration of the recovery period, $\tau_0$ is a coefficient, $E_\tau$ is activation energy of a time constant τ of escape of a carrier from a gate insulating film of the drive transistor, k is a Boltzmann constant, T is temperature, and γ is a predetermined constant; and correct the signal voltage in accordance with the amount of threshold voltage shift.

5. A method for driving a display device including a display, which includes light-emitting pixels each of which includes a light-emitting element and a drive transistor, the drive transistor including a gate electrode, a source electrode and a drain electrode, and being configured to supply a current to the light-emitting element to cause the light-emitting element to emit light; a memory that stores correction data, and a signal line driving circuit configured to supply a signal voltage applied between the gate electrode and the source electrode of the drive transistor, the method comprising:

accessing the memory that stores the correction data, which includes a representative drive transistor threshold voltage deterioration curve, characteristics of the drive transistor of each light-emitting pixel, and an accumulated stress of the drive transistor of each light-emitting pixel;

calculating, using the correction data stored in the memory, an amount of threshold voltage shift of the drive transistor on the basis of an amount of deterioration of a threshold voltage of the drive transistor during a deterioration period in which the signal voltage is kept at a value that is not zero and an amount of recovery of the threshold voltage of the drive transistor during a recovery period in which the signal voltage is kept at zero;

referring to a representative deterioration curve that shows a relationship between an application time of the signal voltage and the amount of threshold voltage shift in a case where the signal voltage is a predetermined reference voltage;

storing, as an accumulated converted time, a value of the application time that corresponds to the amount of threshold voltage shift on the representative deterioration curve;

converting a duration of the deterioration period into a converted time that is a time required for deteriorating the threshold voltage of the drive transistor by the amount of deterioration in a case where the signal voltage is the reference voltage;

calculating the accumulated converted time at an end of the deterioration period by adding the converted time to the accumulated converted time at a start of the deterioration period;

calculating the amount of threshold voltage shift at the end of the deterioration period by calculating a value of the amount of threshold voltage shift that corresponds to the accumulated converted time at the end of the deterioration period on the representative deterioration curve; and correcting the signal voltage in accordance with the amount of threshold voltage shift.

6. The method for driving a display device according to claim 5, the method further comprising:

calculating the amount of threshold voltage shift at an end of the recovery period by subtracting the amount of recovery from the amount of threshold voltage shift at a start of the recovery period; and calculating the accumulated converted time at the end of the recovery period by calculating a value of the application time that corresponds to the amount of threshold voltage shift at the end of the recovery period on the representative deterioration curve.

7. The method for driving a display device according to claim 5, the method further comprising:

converting the duration $t_d$ of the deterioration period into the converted time $t_{d_ref}$ in accordance with the following equation:

$$t_{d_ref} = \left(\frac{V_{gs_ref} - V_{th0} + V_{offset}}{V_{gs_d} - V_{th0} + V_{offset}}\right)^{-\frac{\alpha}{\beta}} t_d$$

where $t_{d_ref}$ is the converted time, $V_{gs_ref}$ is the reference voltage, $V_{gs_d}$ is the signal voltage, $V_{th0}$ is the threshold voltage of the drive transistor before application of the signal voltage, and α, β, and $V_{offset}$ are predetermined constants; and calculating the amount of deterioration $\Delta V_{th_d}$ in accordance with the following equations:

$$\Delta V_{th_d} = A(V_{gs_ref} - V_{th0} + V_{offset})^{\alpha} t_{d_ref}^{\beta}$$

and $$A = A_0 \exp\left(-\frac{E_a}{kT}\right)$$

where $A_0$ is a constant, $E_a$ is activation energy of the threshold voltage shift, k is a Boltzmann constant, and T is temperature.

* * * * *